US008757030B2

(12) United States Patent
Ochs

(10) Patent No.: US 8,757,030 B2
(45) Date of Patent: Jun. 24, 2014

(54) BOTTLE CAP OPENER

(75) Inventor: Christopher Cullen Ochs, Minneapolis, MN (US)

(73) Assignee: Christopher Cullen Ochs, Minneapolis, MN (US)

( * ) Notice: Subject to any disclaimer, the term of this patent is extended or adjusted under 35 U.S.C. 154(b) by 245 days.

(21) Appl. No.: 13/451,189

(22) Filed: Apr. 19, 2012

(65) Prior Publication Data

US 2012/0318103 A1 Dec. 20, 2012

Related U.S. Application Data

(60) Provisional application No. 61/496,685, filed on Jun. 14, 2011.

(51) Int. Cl.

| | |
|---|---|
| ***B67B 7/00*** | (2006.01) |
| ***B67B 7/14*** | (2006.01) |
| ***B67B 7/18*** | (2006.01) |
| ***B67B 7/16*** | (2006.01) |

(52) U.S. Cl.
USPC ..... 81/3.25; 81/3.4; 81/3.55

(58) Field of Classification Search
USPC ..... 81/3.25, 3.27, 3.57, 3.55, 3.41
See application file for complete search history.

(56) References Cited

U.S. PATENT DOCUMENTS

| | | | | | |
|---|---|---|---|---|---|
| 2,964,763 | A | * | 12/1960 | Nagy et al. | 7/152 |
| 5,621,936 | A | * | 4/1997 | Penaligon et al. | 7/151 |
| 5,911,794 | A | * | 6/1999 | Nordhoff | 81/3.55 |
| 6,098,830 | A | * | 8/2000 | Jamieson | 220/259.1 |
| D503,516 | S | * | 4/2005 | Wysopal | D2/866 |
| D521,332 | S | * | 5/2006 | Dighton et al. | D8/38 |
| D540,130 | S | * | 4/2007 | Wysopal | D8/34 |
| 7,284,284 | B2 | * | 10/2007 | Wysopal | 2/209.13 |
| D571,539 | S | * | 6/2008 | Valcourt | D2/866 |
| D582,131 | S | * | 12/2008 | French et al. | D2/866 |
| 7,568,250 | B2 | * | 8/2009 | Menard-Flanagan | 7/151 |
| 2004/0117894 | A1 | * | 6/2004 | Kuo | 2/209.13 |

* cited by examiner

*Primary Examiner* — Monica Carter
*Assistant Examiner* — Danny Hong
(74) *Attorney, Agent, or Firm* — Winthrop & Weinstine; Jeff Stone

(57) ABSTRACT

The invention provides a bottle cap opener capable of sliding into an adjustable position along the bill of a cap with minimal peripheral vision of the opener. The bottle cap opener may be removed by a user to engage a bottle cap for removal from an associated bottle, then slidably replaced on the cap bill. The bottle cap opener comprises a contoured profile to match the contoured profile of the cap bill to minimize peripheral vision involvement and a curved shaping that is complementary with the curved shaping of the cap bill to maximize closeness of fit between the opener and the surface of the cap bill. The opener further comprises a space for individualized customization.

10 Claims, 4 Drawing Sheets

BOTTLE CAP OPENER

CROSS-REFERENCE TO RELATED APPLICATIONS

The present application claims priority under 35 U.S.C. §119(e) to provisional application No. 61/496,685, filed on Jun. 14, 2011.

BACKGROUND OF THE INVENTION

1. Field of the Invention

The invention relates to an apparatus designed to slide onto the bill of a baseball cap for storage and transport. The bottle opener apparatus may be subsequently slid off the bill of the baseball cap as desired for use in removing a bottle cap from a bottle.

2. Description of the Related Art

Generally, known bottle cap openers that are associated with a baseball cap are built into and/or non-removably integrated with the bill of the cap. Consequently, the region of the bottle opener that the bottle cap is inserted, and which applies the structure and leveraging force to remove the bottle cap from the bottle must be exposed in some way. In some cases, the opening region is disposed below the bill of the cap, allowing access for the bottle cap. This arrangement is undesirable because, inter alia, a large portion of the bottle opener device extends into the peripheral vision of the cap wearer.

In other cases, the bottle opener device is roughly aligned with the edge of the bill, thereby eliminating the peripheral vision issue. However, this arrangement requires locating the opening region of the device on the cap bill, eliminating access thereto by the bottle cap for removal. As a consequence, this known structure requires removal of part of the bill of the cap in the same or similar shaping as the opening region of the device. In this way, the wearer of the cap may insert the bottle cap into the opening region of the device for removal. Thus, a customized cap must be manufactured with the bottle opener device since the device is non-removably integrated into the structure of the cap's bill.

The present invention addresses, inter alia, these issues.

BRIEF SUMMARY OF THE INVENTION

The invention provides a bottle cap opener capable of sliding into an adjustable position along the bill of a cap with minimal peripheral vision of the opener. The bottle cap opener may be removed by a user to engage a bottle cap for removal from an associated bottle, then slidably replaced on the cap bill. The bottle cap opener comprises a contoured profile to match the contoured profile of the cap bill to minimize peripheral vision involvement and a curved shaping that is complementary with the curved shaping of the cap bill to maximize closeness of fit between the opener and the surface of the cap bill. The opener further comprises a space for individualized customization.

The Figures and the detailed description which follow more particularly exemplify these and other embodiments of the invention.

BRIEF DESCRIPTION OF THE DRAWINGS

The invention may be more completely understood in consideration of the following detailed description of various embodiments of the invention in connection with the accompanying drawings, which are as follows.

DETAILED DESCRIPTION OF THE INVENTION, INCLUDING THE BEST MODE

Figure 1:
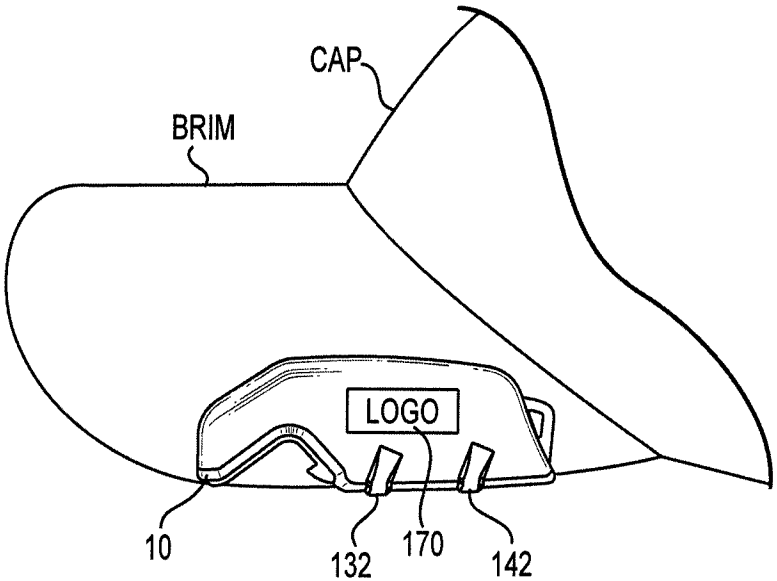
FIG. 1 is a partial cutaway view of one embodiment of the bottle cap opener of the present invention slidably retained on the brim of a baseball cap.

While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention.

Several embodiments of the present invention are described in provisional application No. 61/496,685, filed on Jun. 14, 2011, which is hereby incorporated in its entirety herein by reference.

FIG. 1 illustrates one embodiment of the bottle cap opener 10 of the present invention removably slid over the brim of a typical baseball cap.

Figure 2:
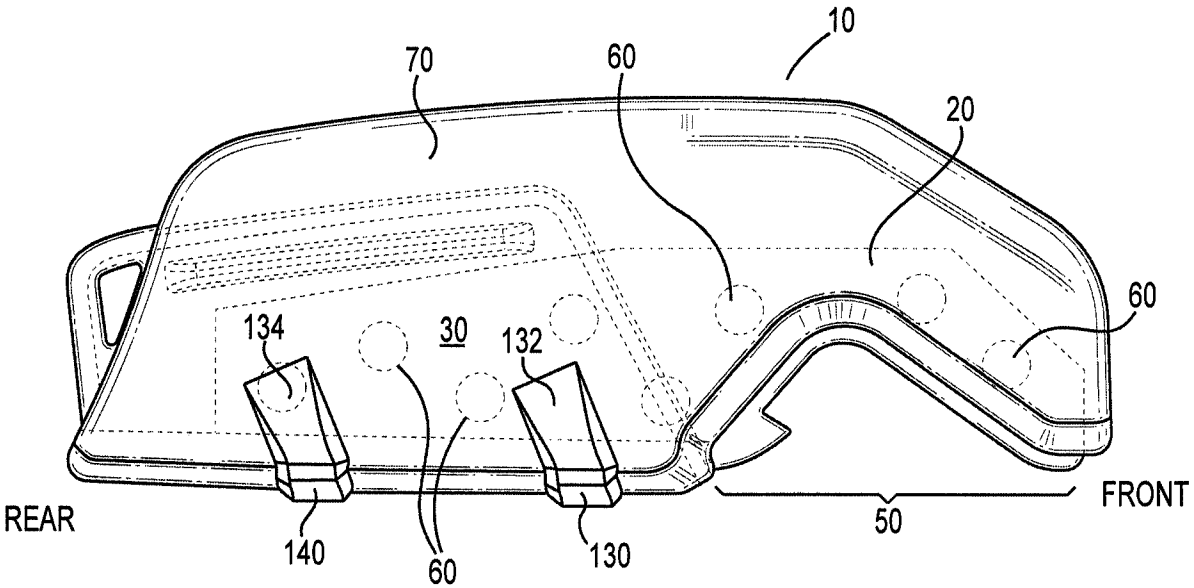
FIG. 2 is a front side view of one embodiment of the bottle cap opener of the present invention.
Figure 3:
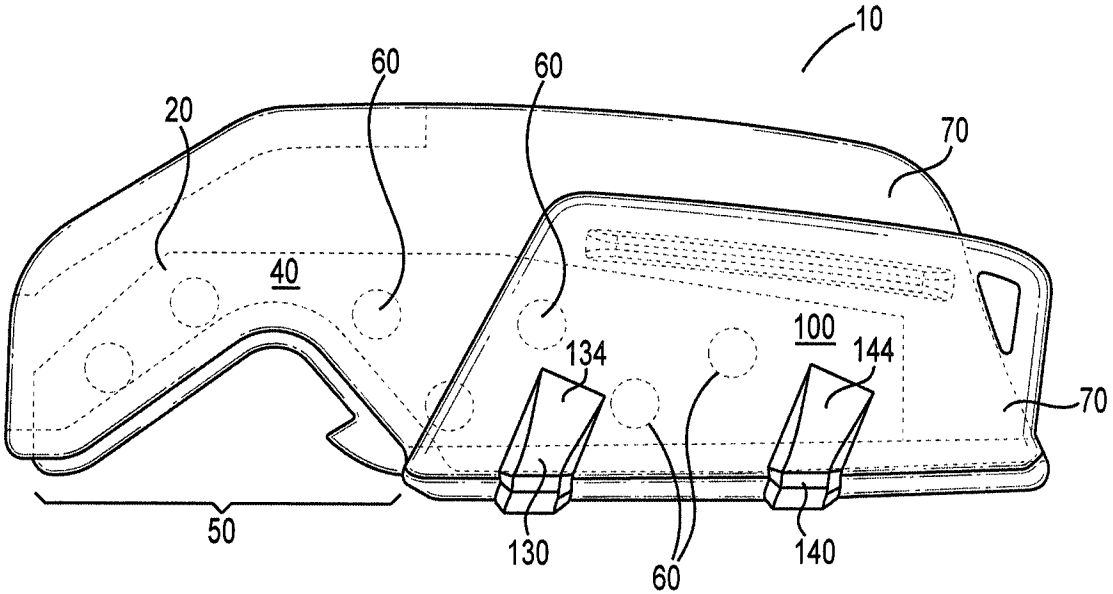
FIG. 3 is a rear side view of one embodiment of the bottle cap opener of the present invention.

FIGS. 2-5 provide front side, rear side, rear view and perspective illustrations, respectively, of one embodiment of the bottle cap opener 10 of the present invention. FIG. 2 illustrates a metal core 20 in phantom or dashed lines that is wrapped in a generally flexible material such as urethane or plastic as is known in the art. The metal core 20 comprises a major outer surface 30, a major inner surface 40, a bottle cap opening region 50 and a plurality of holes 60 extending through the major outer and inner 30,40 surfaces. Thus the plurality of holes 60 extend through the metal core 20

The opener 10 further comprises a wrapping 70 that partially surrounds the metal core, leaving the bottle cap opening region 50 exposed, i.e., unwrapped, thereby allowing the metal bottle cap opening region 50 access to the bottle cap for leveraged removal thereof. The wrapping 70 further comprises a flat region 80 extending from a lower portion of the major inner surface 40 to a minor inner surface 90, the flat 80 having a length L. The minor inner surface 90 opposes the major inner surface 40, the surfaces 40, 90 being substantially parallel to one another. The wrapping 70 also defines a minor outer surface 100.

A channel 110 is defined by at least a portion of the major inner surface 40, the flat 80 and at least a portion of the minor inner surface 90. The channel 110 comprises a longitudinal axis 120 and a transverse axis 130, whereby the transverse axis 130 is at substantially a 90 degree angle, or normal, to the longitudinal axis 120.

The wrapping 70, as discussed supra, covers partially the metal core 20, leaving the bottle cap opening region 50 exposed. The wrapping 70 further defines the flat, minor inner and outer surfaces 90, 100 and the channel 110 and is manufactured and applied through manufacturing and molding techniques well known to the skilled artisan and that are not part of the present invention. The wrapping 70, when formed around the core 20, fills the plurality of holes 60, thereby firmly fixing and/or retaining the metal core 20 within wrapping 70 to prevent movement of core 20 during the process of leveraging a bottle cap off of a bottle using bottle cap removing region 50.

In addition, the wrapping further comprises at least two grippable protrusion pairs, a front grippable protrusion pair 130 defined by the wrapping 70, the first of the front grippable protrusions 132 is positioned over the major outer surface 30 of the core 20 and the second of the front grippable protrusions 134 positioned over the minor outer surface 100 of the core 20. The front grippable protrusion pair 130 is positioned near the front of channel 110, i.e., near the bottle cap opening region 50. The front grippable protrusion pair 130 is aligned such that it is both substantially transverse to the channel's longitudinal axis 120 and substantially parallel to the channel's transverse axis 130. Thus, the first and second front protrusions 132, 134 are opposed to each other.

The second of the at least two grippable protrusion pairs, a rear grippable protrusion pair 140 is also defined by wrapping 70. The first rear grippable protrusions 142 is positioned over the major outer surface 30 of the core 20 and the second of the rear grippable protrusions 144 is positioned over the minor outer surface 100 of the core 20. The rear grippable protrusion pair 140 is positioned near the rear of channel 110, i.e., away from the bottle cap opening region 50. The rear grippable protrusion pair 140 is aligned such that it is both substantially transverse to the channel's longitudinal axis 120 and substantially parallel to the channel's transverse axis 130. Thus, the first and second rear protrusions 142, 144 are opposed to each other.

Moreover, the front grippable protrusion pair 130 and the rear grippable protrusion pair 140 are aligned in a substantially parallel manner with each other.

Figure 5:
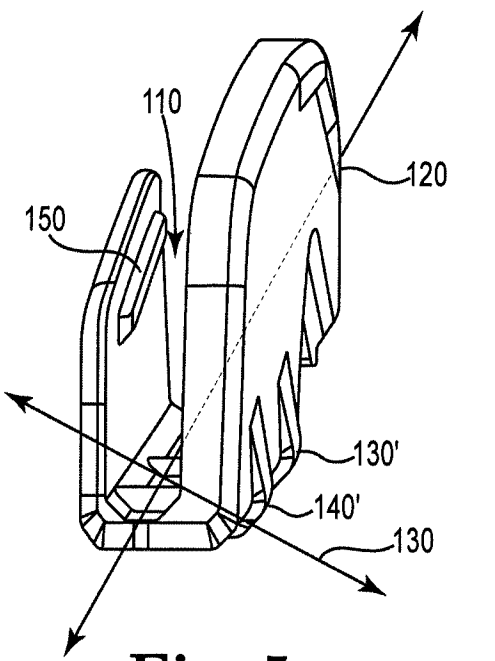
FIG. 5 is a perspective view of one embodiment of the bottle cap opener of the present invention.
Figure 4:
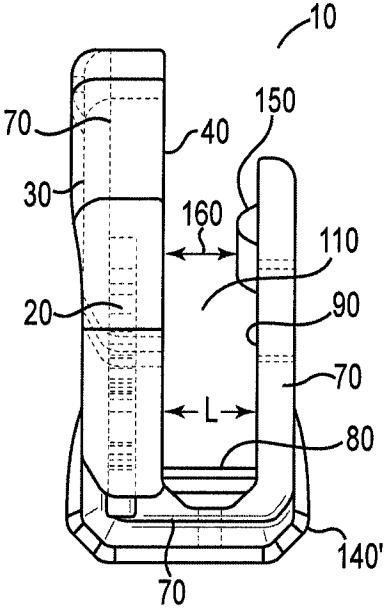
FIG. 4 is a rear view of one embodiment of the bottle cap opener of the present invention.

An alternative embodiment for the protrusion pairs 130, 140 as best illustrated in FIGS. 4 and 5 comprises front and rear grippable protrusions 130' and 140' which are also formed by wrapping 70. Front grippable protrusion 130' is disposed on wrapping 70 over the major outer surface 30 of core 20 and positioned proximate to a front location of the channel 110, i.e., positioned proximate the bottle cap opening region 50. Front grippable protrusion 130' continues underneath channel 110 and around to the minor outer surface 100. The front grippable protrusion 130' is aligned substantially transversely to the channel's longitudinal axis 120.

Rear protrusion 140' is disposed on wrapping 70 over the major outer surface 30 of core 20 and positioned proximate to a rear location of the channel 110, i.e., positioned away from the bottle cap opening region 50. Rear grippable protrusion 140' continues underneath channel 110 and around to the minor outer surface 100. The rear grippable protrusion 140' is aligned substantially transversely to the channel's longitudinal axis 120. As a result of this alignment, front and rear grippable protrusions 130' and 140' are substantially parallel with one another.

Channel 110 defines a first width corresponding with length L of flat 80, which is roughly correspondent with the width of a baseball cap brim, thereby allowing sliding access of a typical baseball cap brim access therein. Channel 110 further comprises a retention lip 150 formed from and defined by wrapping 70 and disposed on the minor inner surface 90. Retention lip 150 comprises a height H and extends into channel 110, thereby narrowing channel 110 between retention lip 150 and major inner surface 40.

Thus, narrowed channel 160 is located between the retention lip 150 and the major inner surface 40. Narrowed channel 160 thus comprises a width that is narrower than the first width, correspondent with length L of flat 80, and, as a result, the width of a typical baseball cap brim. This structural arrangement, combined with the flexible nature of the minor inner and outer surfaces 90, 100, allows forcible, but removable, sliding retention of the brim inserted through the narrowed channel 160 and further into channel 110.

In addition, a flattened branding or marketing surface 170 is provided as best seen in FIG. 1. The surface 170 is disposed above the first front and first rear grippable protrusions 132, 144.

In certain embodiments, a retention hole 170 for, e.g., key ring access and securing, is provided through the minor outer and inner surfaces 90, 100.

The present invention should not be considered limited to the particular examples described above, but rather should be understood to cover all aspects of the invention. Various modifications, equivalent processes, as well as numerous structures to which the present invention may be applicable will be readily apparent to those of skill in the art to which the present invention is directed upon review of the present specification.

What is claimed is:

1. A bottle cap opener slidably attached to the bill of a cap, the bill having a width, comprising:

a metal core having:

a major outer surface, a major inner surface, a plurality of holes extending through the major outer surface and through the major inner surface, and a bottle cap opening region;

a minor inner surface;

a minor outer surface;

a flat extending from at least a portion of the major inner surface of the core and the minor inner surface and having a length;

a channel defined by at least a portion of the major inner surface of the core, the flat and at least a portion of the minor inner surface and having a longitudinal axis and a transverse axis, the transverse axis normal to the longitudinal axis;

a wrapping partially surrounding the metal core, and filling the plurality of holes through the major outer and inner surfaces of the core, the wrapping further covering the flat and minor inner and minor outer surfaces and having:

at least two grippable protrusion pairs formed from the wrapping comprising:

front grippable protrusion pair comprising a first front grippable protrusion defined by the wrapping and disposed over the major outer surface of the core and positioned proximate a front location of the channel and a second front opposing grippable protrusion defined by the wrapping and disposed over the minor outer surface and positioned proximate a front location of the channel, the front grippable protrusion pair aligned transverse to the channel's longitudinal axis and substantially parallel with the channel's transverse axis, a rear grippable protrusion pair comprising a first rear grippable protrusion defined by the wrapping and disposed over the major outer surface of the core and positioned proximate a rear location of the channel and a second rear opposing grippable protrusion defined by the wrapping and disposed over the minor outer surface positioned proximate a rear location of the channel, the rear grippable protrusion pair aligned transverse to the channel's longitudinal axis, substantially parallel with the channel's transverse axis and substantially parallel with the front grippable protrusion pair alignment;

the channel further comprising:

a first width defined by the flat, wherein the brim of the cap is slidably received, a retention lip formed from the wrapping and disposed on the minor inner surface the retention lip having a height which extends into the width of the channel, thereby reducing the width of the channel at the location of the retention lip, and a narrowed channel between the retention lip and the major inner surface having a width that is narrower than the first width of the channel and the width of the cap brim and wherein the brim of the cap is removably retained when the brim is inserted therethrough; and a customizable branding surface on the wrapping above the first front and first rear grippable protrusions.

2. The bottle cap opener of claim 1, wherein the wrapping comprises urethane.

3. The bottle cap opener of claim 1, wherein the wrapping comprises a plastic.

4. The bottle cap opener of claim 1, further comprising a retention hole through the minor outer and minor inner surfaces.

5. A bottle cap opener slidably attached to the bill of a cap, the bill having a width, comprising:

a metal core having:

a major outer surface, a major inner surface, a plurality of holes extending through the major outer surface and through the major inner surface of the metal core, and a bottle cap opening region;

a minor inner surface;

a minor outer surface;

a flat extending from at least a portion of the major inner surface and the minor inner surface and having a length;

a channel defined by at least a portion of the major inner surface, the flat and at least a portion of the minor inner surface and having a first width defined by the length of the flat, and the channel further comprising:

a longitudinal axis, a transverse axis normal to the longitudinal axis, a retention lip disposed on the minor inner surface the retention lip having a height which extends into the width of the channel, and a narrowed channel between the retention lip and the major inner surface having a width that is narrower than the width of the cap brim and that removably retains the brim of the cap when the brim is inserted therein;

a wrapping partially surrounding the metal core, and filling the plurality of holes through the major outer and inner surfaces of the core, the wrapping further covering the flat and minor inner and minor outer surfaces and comprising:

a front grippable protrusion formed from the wrapping and disposed over the major outer surface of the core, the channel and the minor outer surface and positioned proximate a front location of the channel, the front grippable protrusion aligned transverse to the channel's longitudinal axis, a rear grippable protrusion formed from the wrapping and disposed over the major outer surface of the core, the channel and the minor outer surface and positioned proximate a rear location of the channel, the rear grippable aligned transverse to the channel's longitudinal axis; and a customizable branding surface formed from the wrapping and disposed on the major outer surface above the front and rear grippable protrusions.

6. The bottle cap opener of claim 5, further comprising the wrapping manufactured from a plastic material.

7. The bottle cap opener of claim 5, further comprising the wrapping manufactured from urethane.

8. The bottle cap opener of claim 7, further comprising a retention hole disposed through the minor outer surface and minor inner surface, forming a hole therethrough.

9. A bottle cap opener slidably attached to the bill of a cap, the bill having a width, comprising:

a metal core having:

a major outer surface, a major inner surface, a plurality of holes extending through the major outer surface and through the major inner surface of the metal core, and a bottle cap opening region;

a minor outer surface;

a minor inner surface;

a flat extending from at least a portion of the major inner surface and the minor inner surface and having a length;

a channel defined by at least a portion of the major inner surface, the flat and at least a portion of the minor inner surface and having a first width defined by the length of the flat, and the channel further comprising a longitudinal axis, a transverse axis arranged normal to the longitudinal axis, a retention lip disposed on the minor inner surface the retention lip having a height which extends into the width of the channel, and a narrowed channel between the retention lip and the major inner surface having a width that is narrower than a width of the cap brim and that removably retains the brim of the cap when the brim is inserted therein;

a wrapping partially surrounding the metal core, and filling the plurality of holes through the major outer and inner surfaces of the core, the wrapping further covering the flat and minor inner and minor outer surfaces and comprising:

a front grippable protrusion formed from the wrapping and disposed over the major outer surface of the core, the channel and the minor outer surface and positioned proximate a front location of the channel, the front grippable protrusion aligned transverse to the channel's longitudinal axis, a rear grippable protrusion formed from the wrapping and disposed over the major outer surface of the core, the channel and the minor outer surface and positioned proximate a rear location of the channel, the rear grippable aligned transverse to the channel's longitudinal axis;

a customizable branding surface formed from the wrapping and disposed on the major outer surface above the front and rear grippable protrusions; and a retention hole disposed through the minor inner surface and minor outer surface.

10. The bottle cap opener of claim 9, wherein the wrapping is manufactured from urethane.

* * * * *